US007292125B2

(12) United States Patent
Mansour et al.

(10) Patent No.: US 7,292,125 B2
(45) Date of Patent: Nov. 6, 2007

(54) MEMS BASED RF COMPONENTS AND A METHOD OF CONSTRUCTION THEREOF

(76) Inventors: Raafat R. Mansour, 310 Amberwood Drive, Waterloo, Ontario (CA) N27 2G2; Mojgan Daneshmand, 704 Zurich Drive, Waterloo, Ontario (CA) N2V 2S8

( * ) Notice: Subject to any disclaimer, the term of this patent is extended or adjusted under 35 U.S.C. 154(b) by 362 days.

(21) Appl. No.: 11/039,860

(22) Filed: Jan. 24, 2005

(65) Prior Publication Data

US 2005/0201672 A1 Sep. 15, 2005

(51) Int. Cl.
*H01P 1/10* (2006.01)

(52) U.S. Cl. ..... 333/258; 333/108

(58) Field of Classification Search ..... 333/101, 333/105, 108, 258

See application file for complete search history.

(56) References Cited

U.S. PATENT DOCUMENTS 6,762,661 B1 * 7/2004 Higgins ..... 333/258

* cited by examiner

*Primary Examiner*—Dean Takaoka
(74) *Attorney, Agent, or Firm*—Daryl W. Schnurr

(57) ABSTRACT

A three dimensional waveguide is integrated with a MEMS structure to control a signal in various RF components. The components include switches, variable capacitors, filters and phase shifters. A controller controls movement of the MEMS structure to control a signal within the component. A method of construction and a method of operation of the component are described. The switches have high power handling capability and can be operated at high frequencies. By integrating a three dimensional waveguide with a MEMS structure, the components can be small in size with good operating characteristics.

41 Claims, 15 Drawing Sheets

MEMS BASED RF COMPONENTS AND A METHOD OF CONSTRUCTION THEREOF

BACKGROUND OF THE INVENTION

1. Field of the Invention

The present invention relates to RF MEMS microwave components and more particularly to integration of MEMS structures with signal supporting forms to develop MEMS-based RF components such as a MEMS waveguide switch. The present invention relates to a method of construction and method of operation.

2. Description of the Prior Art

Communication, wireless, and satellite payload systems employ sophisticated switch matrices to provide signal routing and redundancy schemes to improve the reliability of both receive and transmit subsystems. The two types of switches that are currently being used are mechanical switches and solid state switches. Mechanical (coaxial and waveguide) switches show good RF performance up to couple of hundred gigahertz with high power handling capability. However, they are heavy and bulky as they employ motors for the actuation mechanism. Solid state switches on the other hand are relatively small in size but they show poor RF performance especially in high frequency applications (40-200 GHz) and they are limited in RF power handling. In some applications, PIN diode waveguide switches have been used. They utilize incorporated PIN diodes inside the waveguide to create ON and OFF states. While these switches are small in size, they have very limited bandwidth, exhibit poor RF performance, and consume relatively high DC power. References to the term MEMS in this application refer to a microelectromechanical system.

RF MEMS switches are good candidates to substitute the existing mechanical switches due to their good RF performance and miniaturized dimensions. However, their high actuating voltage and low power handling is still a major obstacle. The "Stand off voltage" or "self biasing" property of electrostatic MEMS switches which is defined as the maximum RF voltage before pulling the beam down, is the main limiting factor in this regard.

SUMMARY OF THE INVENTION

It is an object of the present invention to provide a MEMS-based RF component having a form that supports a signal in combination with a MEMS structure having at least two positions that can be used to control the signal. It is a further object of the present invention to provide a MEMS-based RF component that can replace existing components in both the high frequency range, low frequency range, high power range and low power range. The high frequency range is considered to be from 40 to 200 GHz. Integrated MEMS actuators replace the existing motors of mechanical waveguide and coaxial switches. It is a further object of the present invention to provide MEMS-based RF components that have a small size, light weight, high power handling and good RF performance when compared to previous devices.

A MEMS-based RF component comprises a form, the form being a three dimensional waveguide. The form is capable of supporting a signal and has at least one of an input and output. The form has a MEMS structure at least partially therein, the MEMS structure being constructed to control an RF signal within the form.

A method of constructing a MEMS-based RF component having a three dimensional waveguide for supporting a signal and a MEMS structure at least partially therein, the method comprising constructing a base plate and a top cover that is sized and shaped to fit on said base plate, incorporating a MEMS structure in one of the base plate and top cover and affixing the cover to the plate to form the component.

A method of operating a MEMS-based RF component having a three dimensional waveguide for said MEMS structure for supporting a signal and a MEMS structure at least partially therein with a controller, the method comprising operating said controller to move the MEMS structure to control a signal in said component.

DESCRIPTION OF A PREFERRED EMBODIMENT

Figure 1:
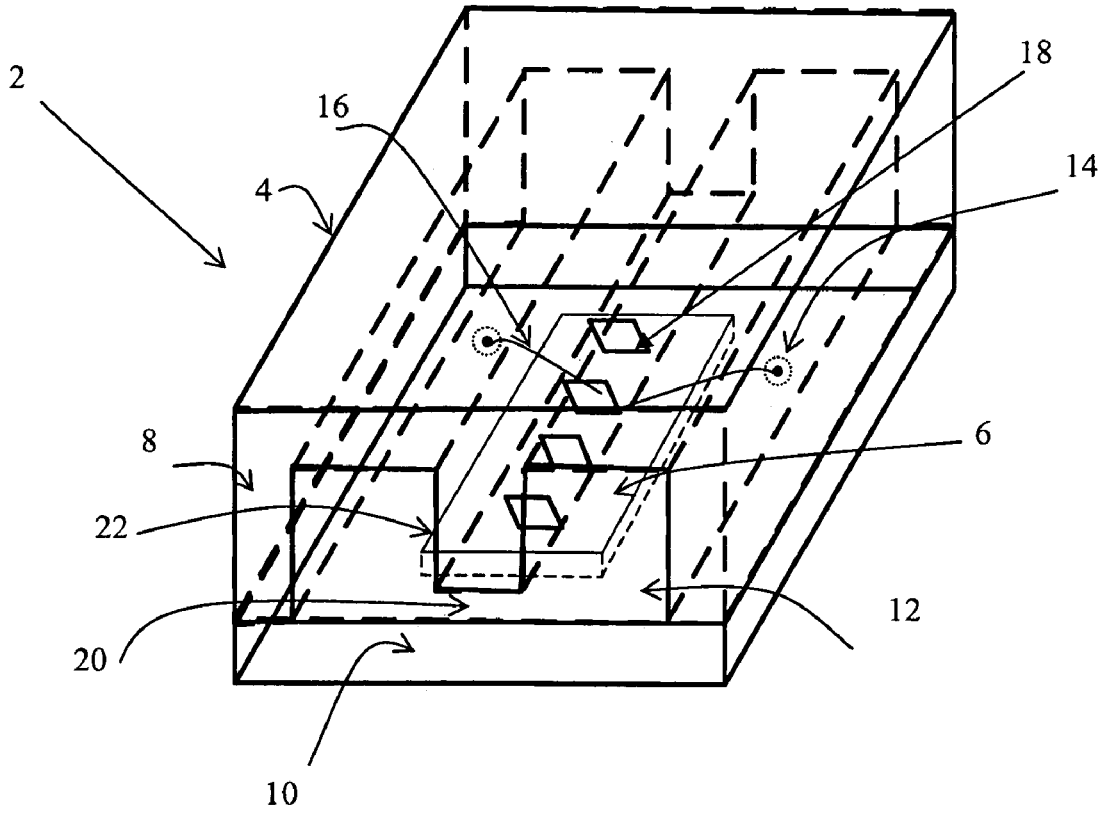
FIG. 1 is a schematic perspective view of a MEMS-based waveguide switch.

FIG. 1 shows a detailed description of the preferred embodiment of the present invention. A switch 2 consists of a waveguide 4 and incorporated MEMS structure 6. The waveguide 4 could be in any type but FIG. 1 describes a single ridge waveguide configuration. The waveguide is constructed from two detached parts of the top cover 8 and bottom plate 10 to facilitate the MEMS structure 6 integration into the waveguide 4. Top cover 8 includes the ridge waveguide channel 12 and the bottom plate 10 incorporates the MEMS structure 6. DC bias of the MEMS structure 6 is provided through DC pins 14 that are wire-bonded 16 to actuators 18. A DC voltage is applied to move the actuators between the OFF and ON states. The electric field is mostly concentrated in a gap 20 between a ridge 22 and the bottom plate 10 where the MEMS structure 6 is located. The MEMS structure 6 can be based on electrostatic or thermal actuators. The requirement is to provide a good short circuit between the ridge 22 and the bottom plate 10 of the waveguide 4 for the OFF state and to remove entirely from the signal path to a position coinciding with an inner wall of the waveguide 4 for the ON state.

Figure 2:
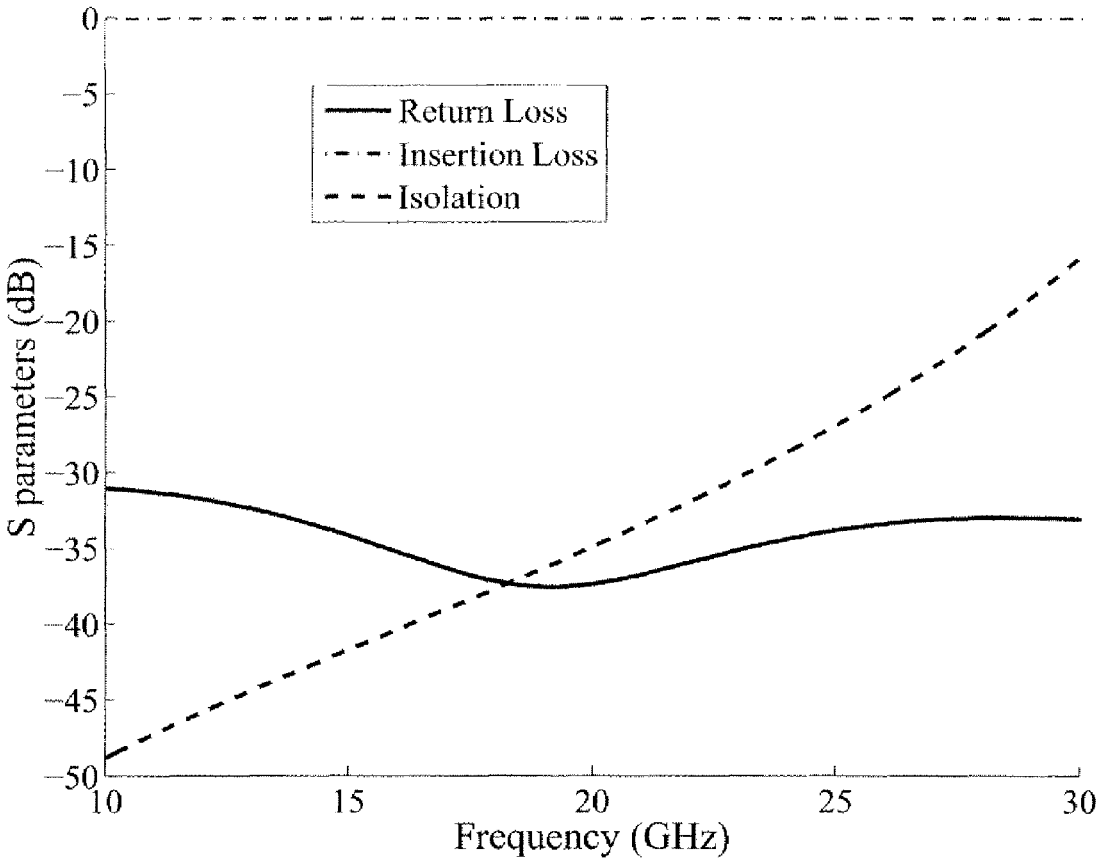
FIG. 2 is a graph of the simulation results for the switch of FIG. 1.

FIG. 2 shows the simulation results for the invention presented in FIG. 1. The number of the actuators is based on the required isolation.

Figure 3A:
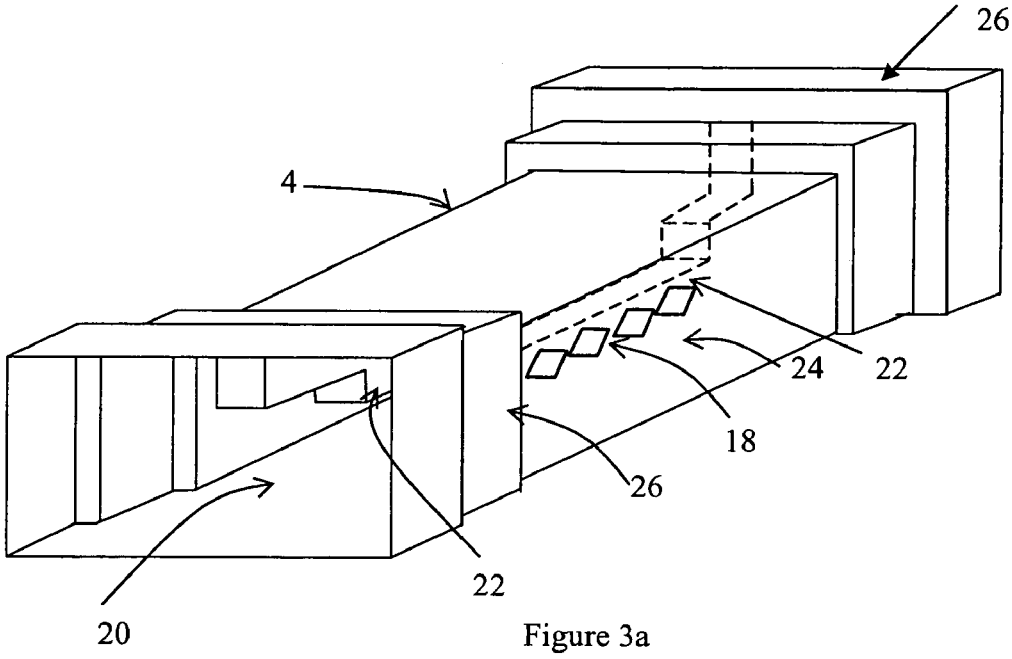
FIG. 3*a* is a schematic perspective view of a rectangular waveguide structure having transformers at an input and output.
Figure 3B:
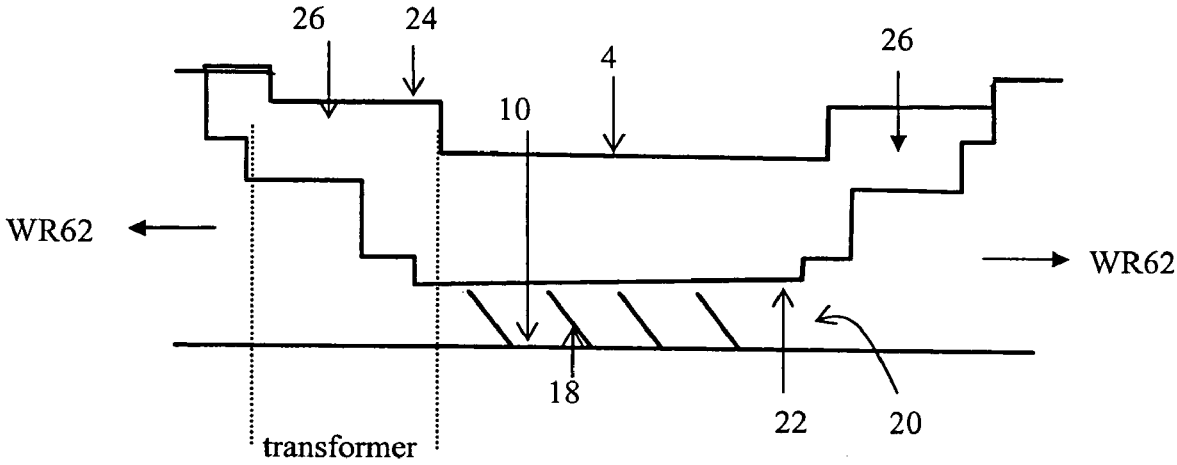
FIG. 3*b* is a schematic side view of the switch of FIG. 3*a;*
Figure 4A:
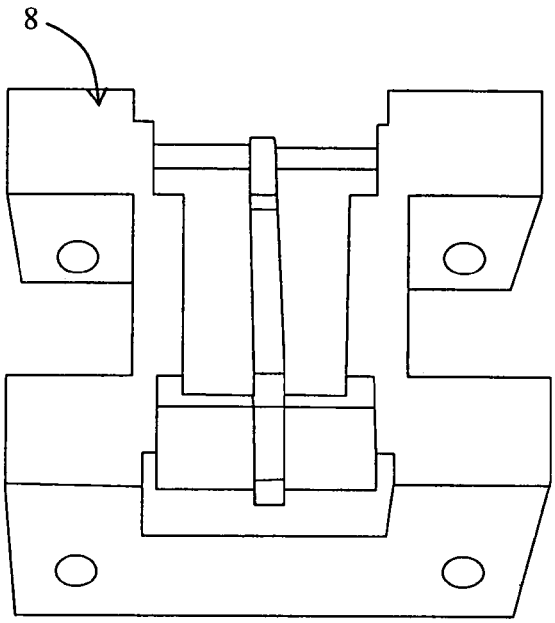
FIG. 4*a* is a top of a disassembled waveguide structure.
Figure 4B:
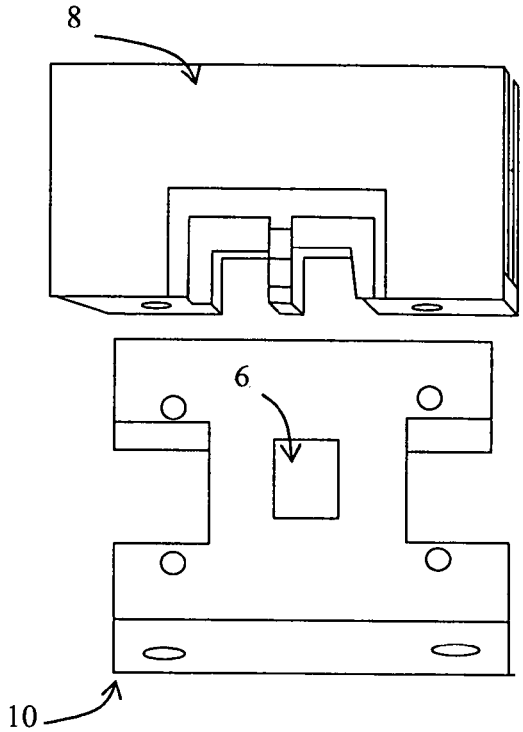
FIG. 4*b* is a bottom view of the waveguide structure.
Figure 4C:
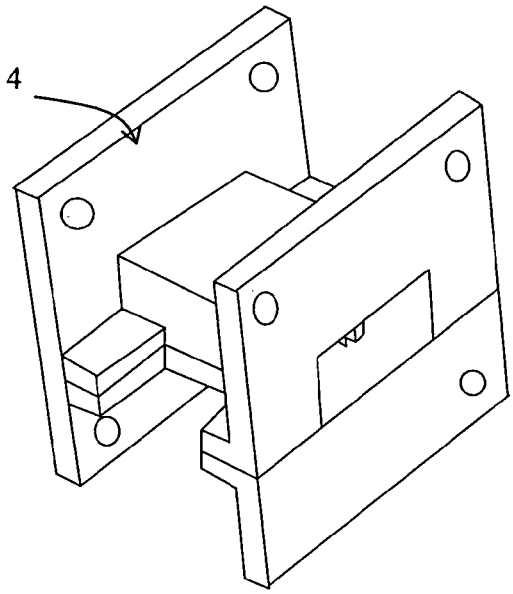
FIG. 4*c* is a perspective view of the waveguide structure.

To integrate the present invention in a standard rectangular waveguide system, another embodiment is illustrated in FIGS. 3*a* and 3*b*. The same reference numerals are used in FIGS. 3*a* and 3*b* as those used in FIG. 1 for those parts that are identical. A switch 24 uses a quarter wavelength transition 26 to any standard waveguide. FIGS. 4*a*, 4*b* and 4*c* show the fabricated structure for the satellite Ku band application and using well known machining processes. For higher frequency range and millimeter wave applications, the structure is fabricated using MEMS process on wafer level. The top cover 8 of the waveguide 4 is fabricated on one wafer using deep RIE and then followed by gold plating. Another wafer is used to fabricate the MEMS unit 6 monolithically with the bottom plate of the waveguide 10. The wafers are bonded together during the packaging stage.

Figure 5A:
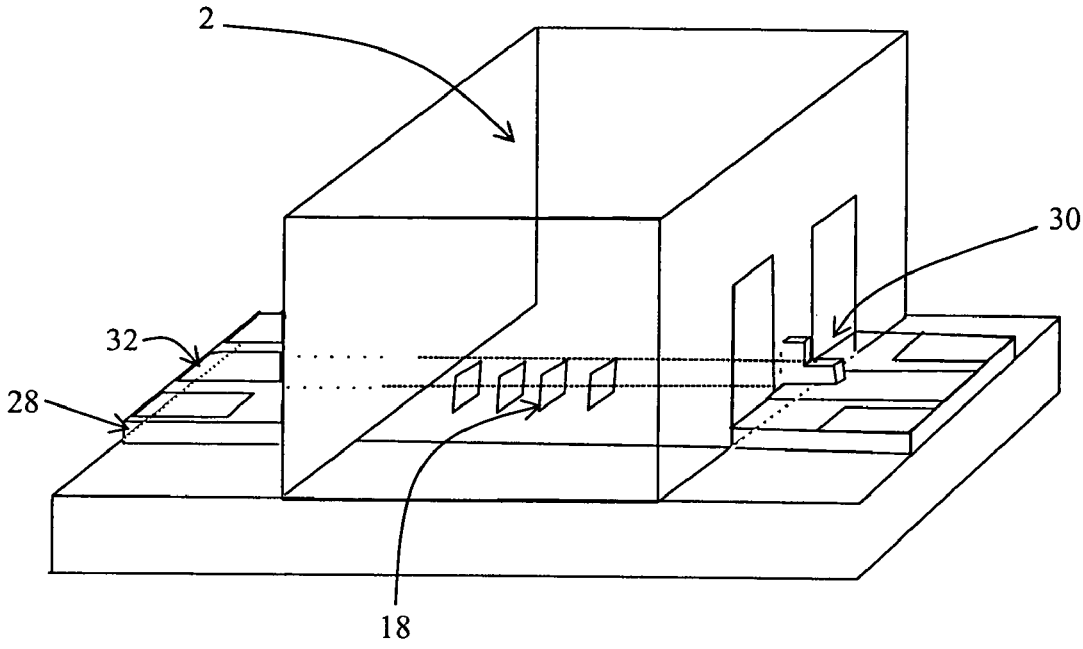
FIG. 5*a* is a schematic perspective view of a connection of a waveguide switch into a planar circuit.
Figure 5B:
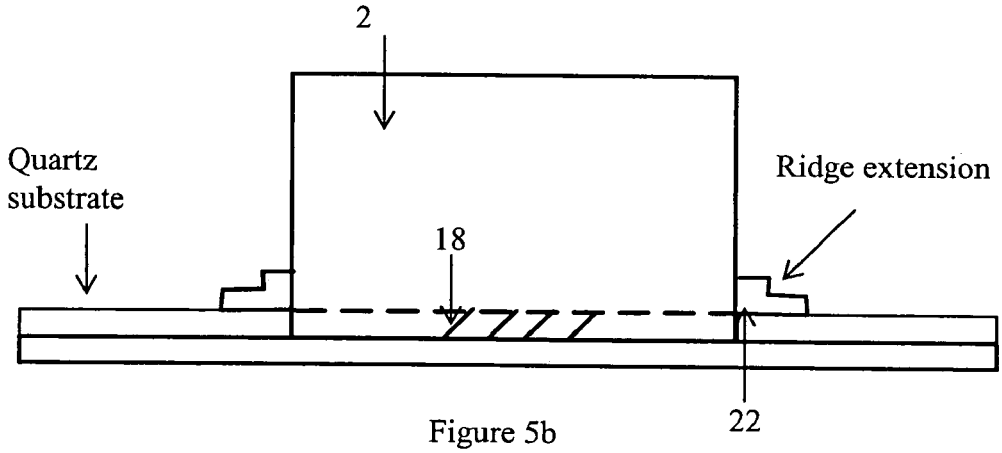
FIG. 5*b* is a schematic side view of the switch of FIG. 5*a;*

Although this technique simplifies the integration with standard waveguide systems, it limits the bandwidth. FIGS. 5*a* and 5*b* show another preferred embodiment to integrate the invention into a planar circuit 28. To transform the signal from waveguide switch 2 (shown in FIG. 1) to a planar circuit 28, a ridge waveguide to coplanar waveguide line transition 30 is used. Line 32 is a coplanar-waveguide.

Figure 6:
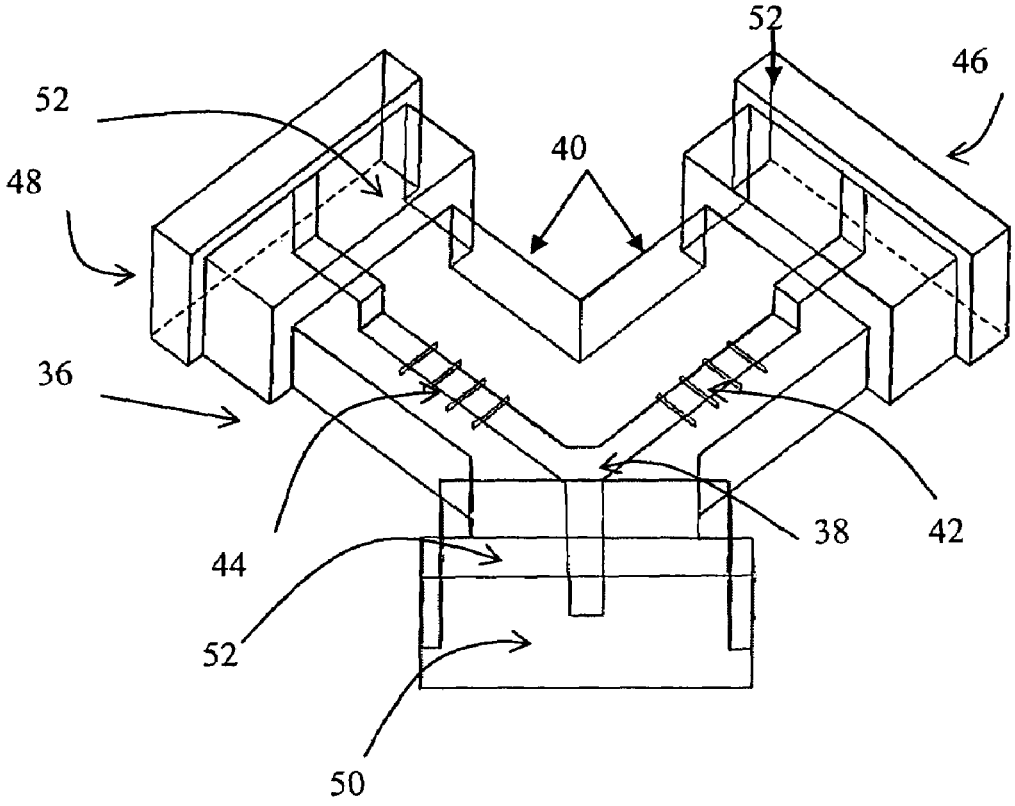
FIG. 6 is a schematic perspective view of a single-pole double-throw MEMS-based waveguide switch.

FIG. 6 shows another embodiment 1 of the present invention in the form of single-pole double-throw switch 36. A T junction 38 is used to join the two output branches 40. MEMS structures (42 and 44) provides a short circuit to turn OFF one of the output ports (46 or 48) at any given time. When one output port 46 is on the other output port is off and vice-versa. This short is transferred to the T junction 38 in the form of open circuit with no effect on the transmitted signal from input 50 to the other output port (48 or 46). Transformers 52 are located at the input 50 and output ports 46 and 48.

Figure 7:
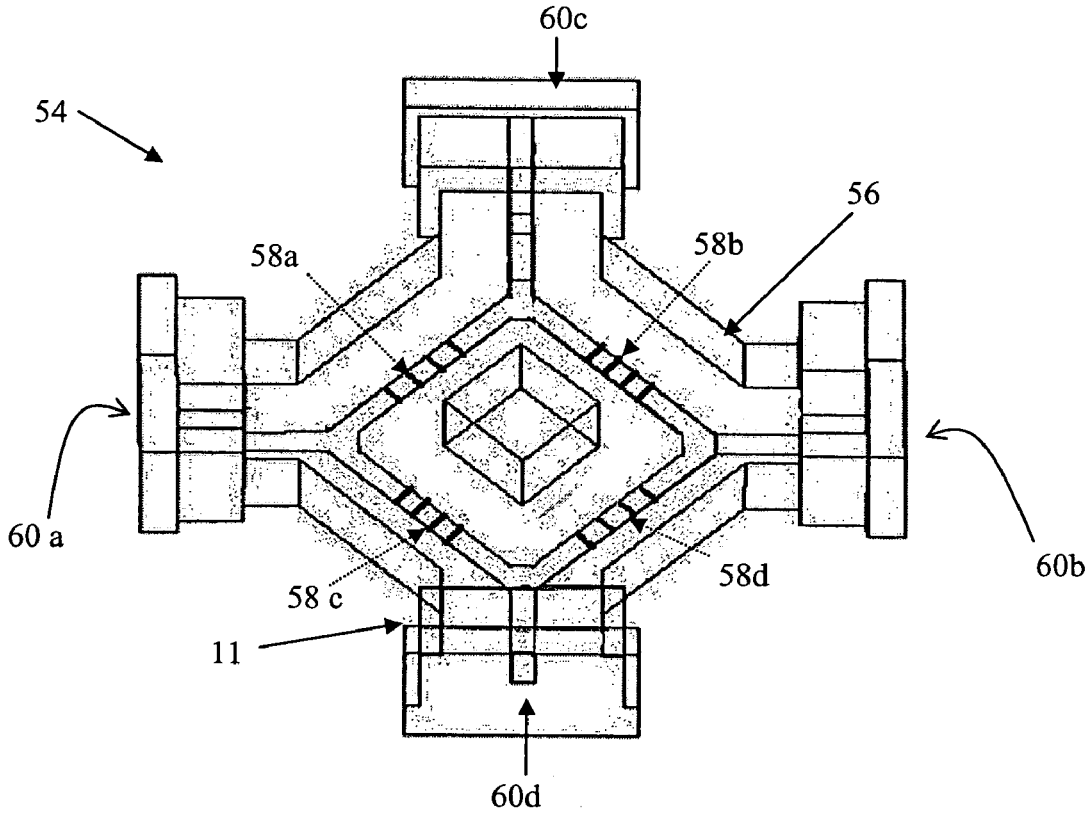
FIG. 7 is a schematic perspective view of a MEMS-based waveguide C-switch.

FIG. 7 illustrates another configuration of the present invention in the form of a transfer switch 54 (C-type). This switch is designed for satellite Ku band applications. However, the switch 54 can be easily extended to higher frequency range. The switch is based on a multi-port waveguide 56 that incorporates four MEMS structures 58*a*, 58*b*, 58*c*, 58*d*. The MEMS structures are integrated inside the waveguide 56 under the ridge (not shown in FIG. 7) where electric field has its maximum intensity. $\lambda/4$ transition to ridge waveguide is utilized at the input ports 60*a*, 60*b*. Two ridge waveguide T-junctions are used to connect the input lines (not shown) to two neighbouring ports. The transfer switch has two operational states. In the state I, ports 60*a*-60*c* and 60*b*-60*d* are connected and the MEMS structures of 58*c* and 58*b* are providing a good short circuit at the frequency range of interest. This results in high isolation between ports 60*a* and 60*d* and between ports 60*b* and 60*c*. An extensive effort is made to design the ridge waveguide discontinuities and the junctions in a way that the transferred impedance of the shunt irises acts as open circuit and does not interfere with the transmitted signal from port 60*a* to port 60*c* and from port 60*b* to port 60*d*. Meanwhile, the other MEMS structures 58*a* and 58*d* are in a position to coincide with the inner wall of the waveguide 56 providing a perfect ridge waveguide transmission line. The operation of the switch in the state II is very similar to that of state I except that there are through paths between ports 60*a*-60*d* and between 60*b*-60*c* and MEMS structures of 58*a* and 58*d* are shorting the waveguide.

Figure 8:
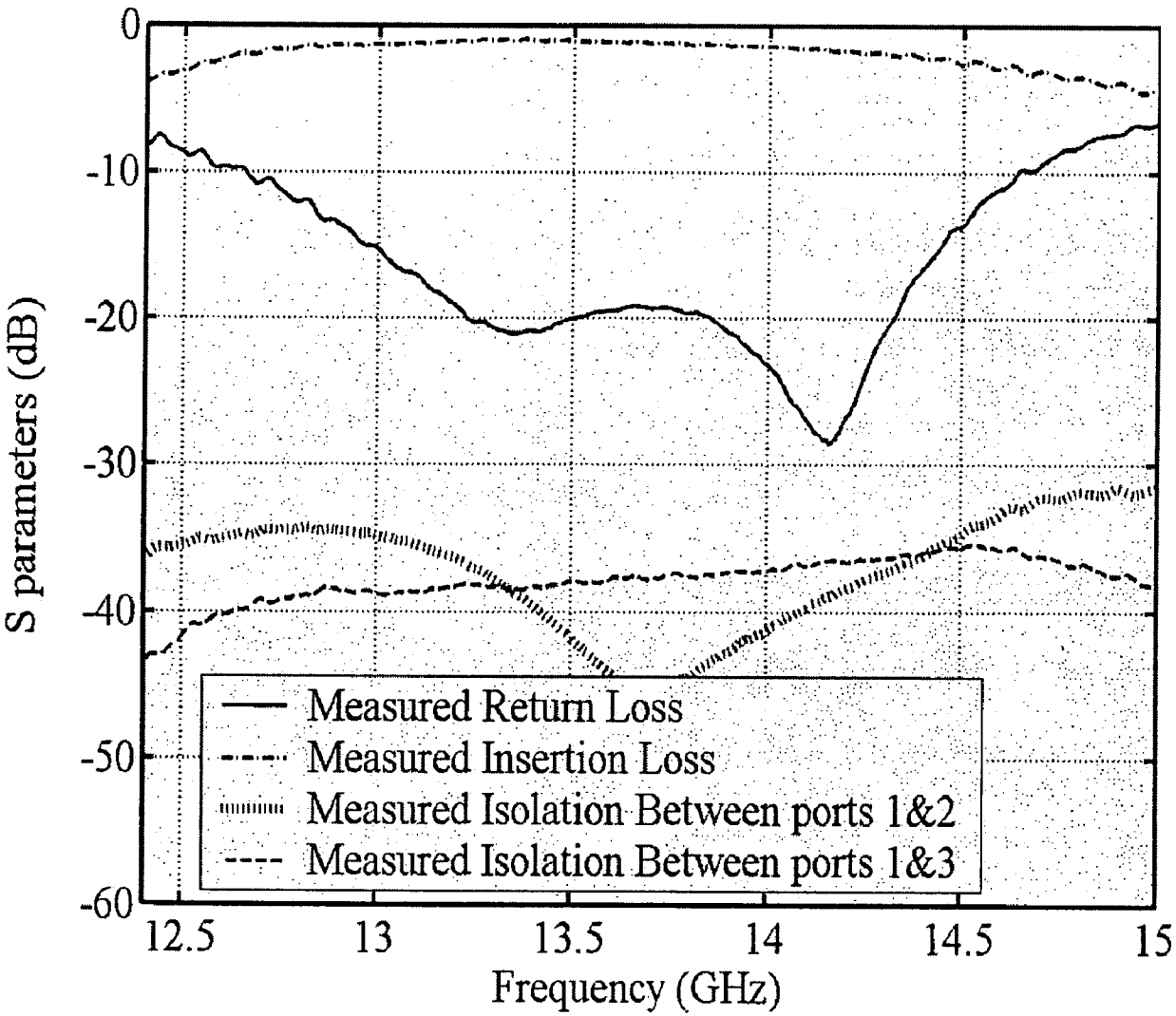
FIG. 8 is a graph of the measured results of the switch shown in FIG. 6.

FIG. 8 shows the measured results for the transfer switch prototype working at satellite Ku band.

Figure 9:
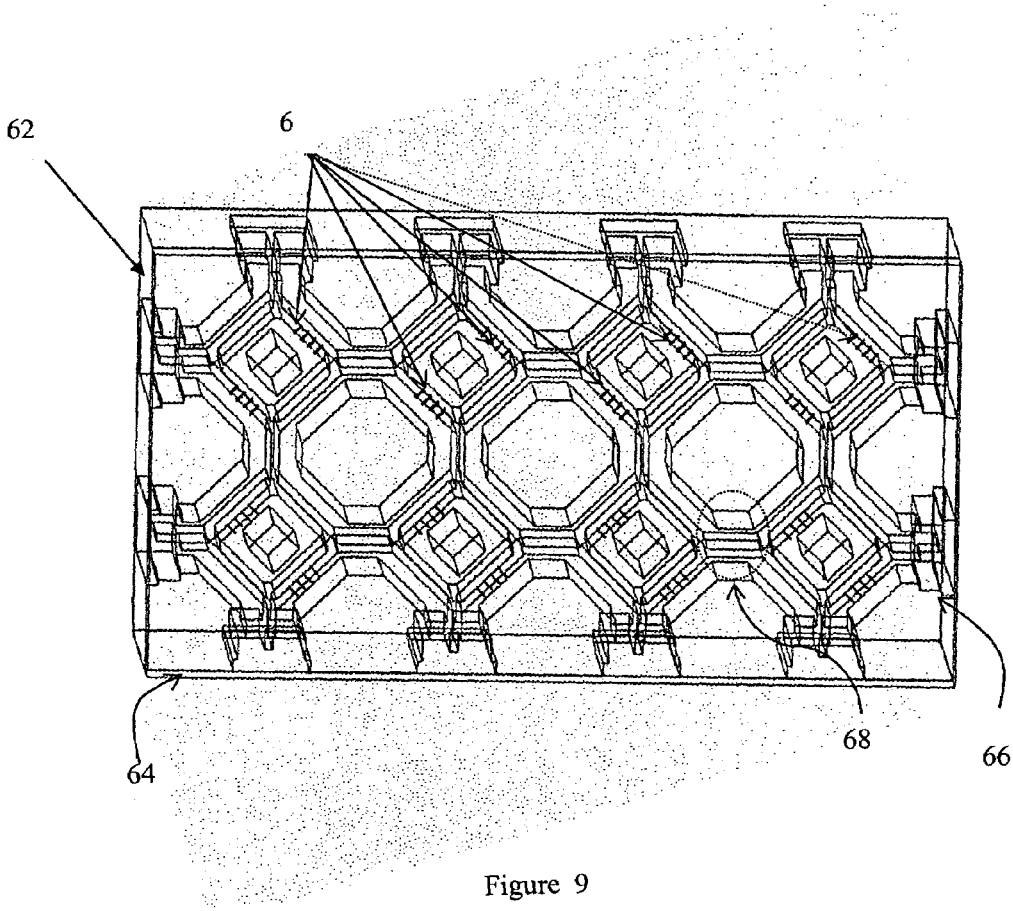
FIG. 9 is a schematic perspective view of a switch matrix made up of MEMS-based on MEMS-based waveguide switches.

Another preferred embodiment is shown in FIG. 9. This shows a switch matrix 62 that is based on the present invention. The entire switch matrix can be fabricated on two detached parts of a bottom plate 64 and a top cover 66. The interconnect lines can be either waveguides 68 or CPW lines 32 (see to FIGS. 5*a* and 5*b*). For millimeter wave applications, the bottom plate 64 incorporates the MEMS structures 6 and/or the planar circuitry 28 (see FIGS. 5*a* and 5*b*), and the top cover 66 includes the waveguide channels. Each part can be fabricated on a separate wafer and then bonded together. The matrix 62 is constructed from several C-switches connected together.

Figure 10:
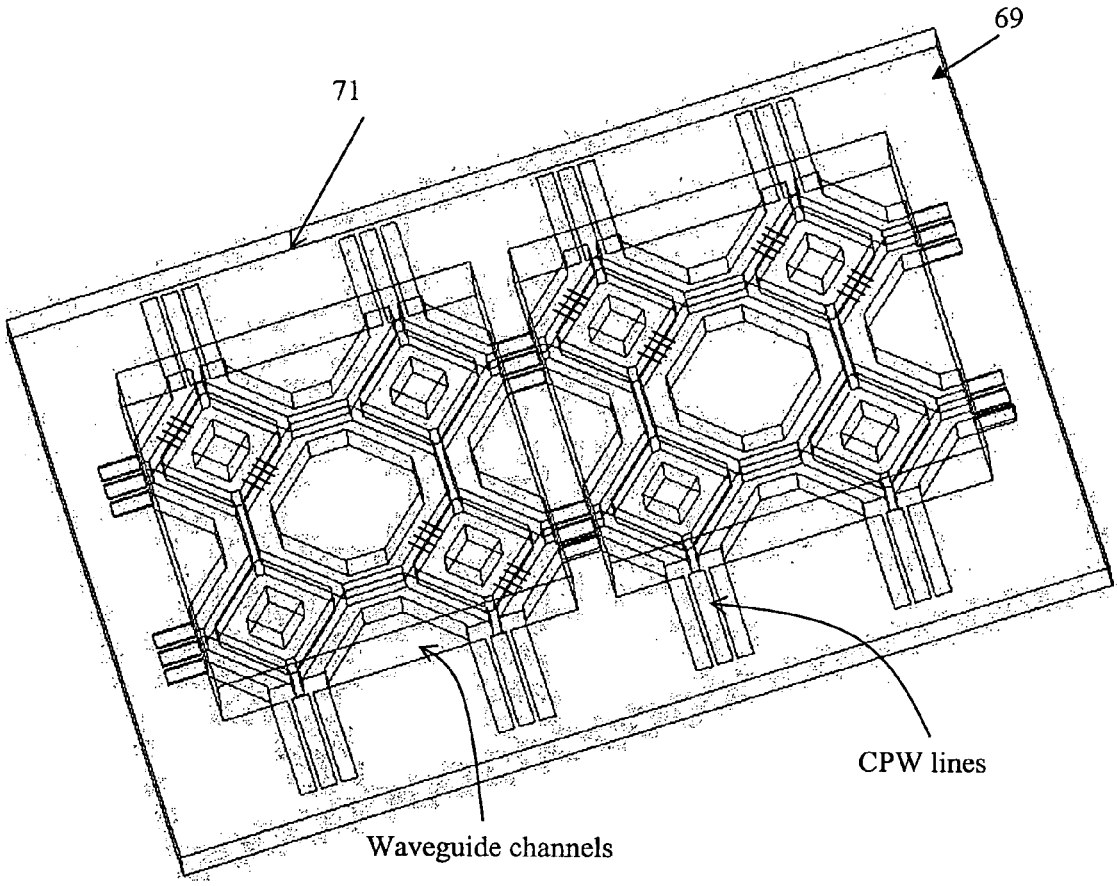
FIG. 10 is a schematic perspective view of RF MEMS waveguide switch integrated with a planar circuit.

FIG. 10 is a schematic perspective view of a switch matrix 69 having a plurality of switches that are essentially the same as the switches in FIG. 9. The MEMS waveguide switches are integrated with a planar circuit 71 that can be coplanar waveguides, microstrip or any other type of microwave integrated circuit.

Figure 11:
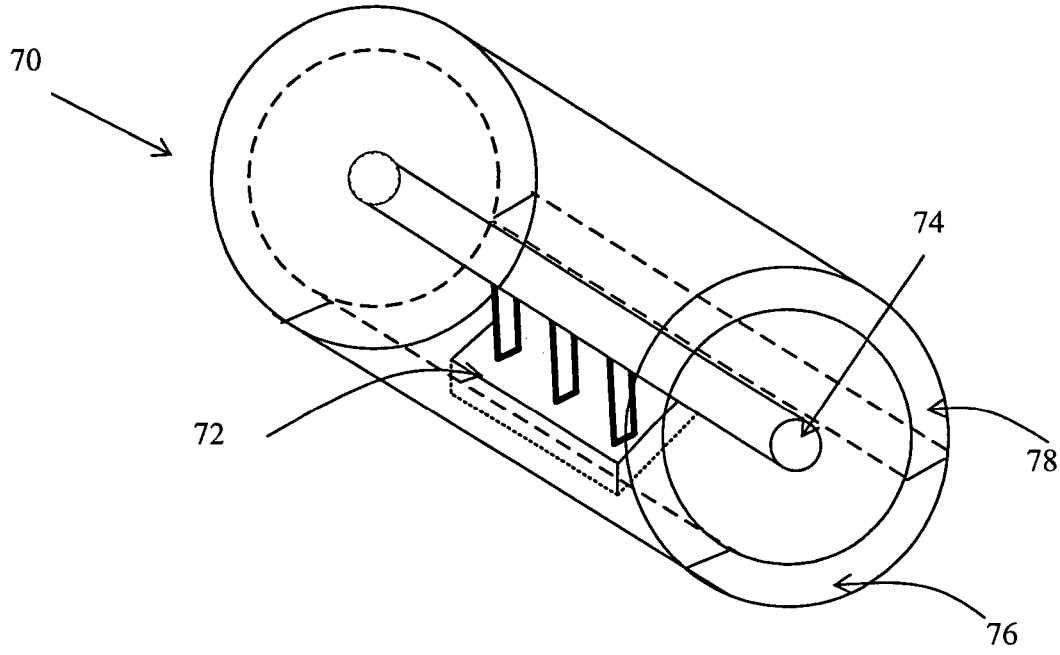
FIG. 11 is a perspective view of an RF MEMS coaxial switch.
Figure 12:
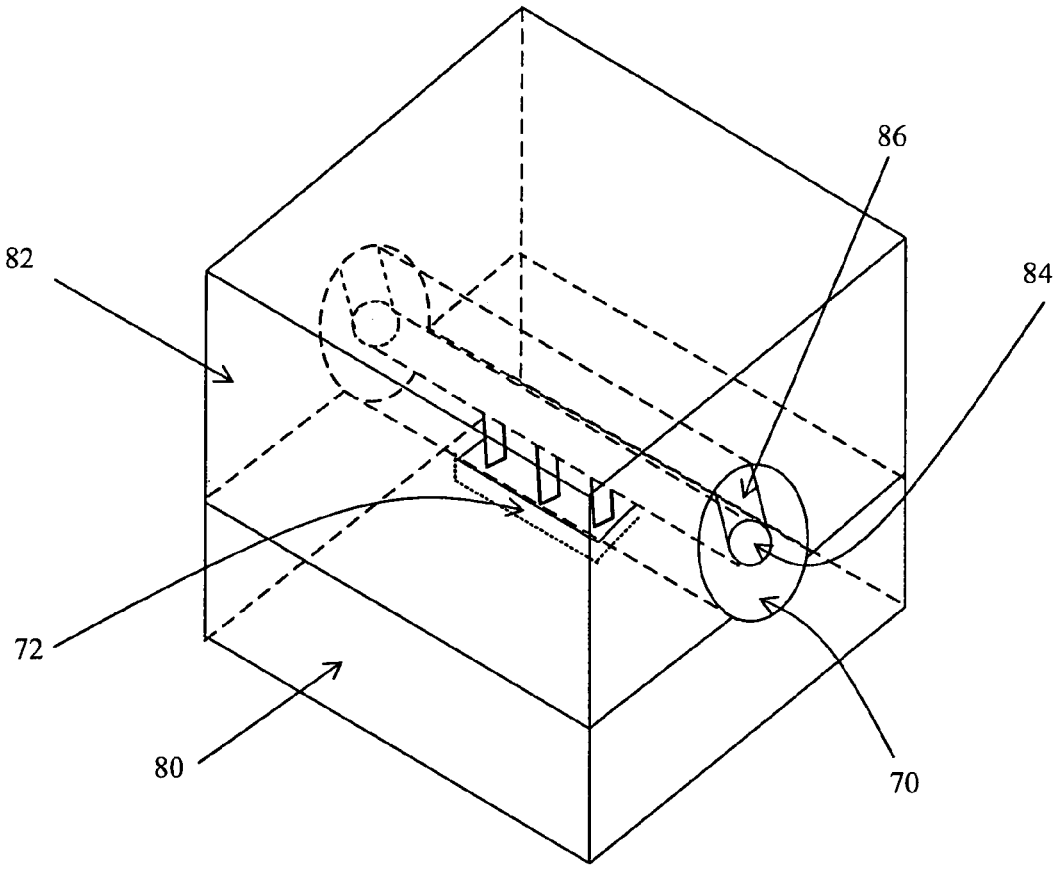
FIG. 12 is a schematic perspective view of the switch of FIG. 10 within a bottom plate and top cover.

Although the present invention has been fully described by way of example in connection with a preferred embodiment thereof, it should be noted that various changes and modifications will be apparent to those skilled in the art. Therefore, unless otherwise stated such changes and modifications depart from the scope of the present invention, they should be construed as being included therein. For example, FIG. 11 shows extension of the idea to another type of switch called an RF MEMS coaxial switch 70. In this embodiment, the MEMS structure 72 is incorporated in the ground shielding of the coax 74 and do not interfere with the signal for the ON state. By activating the MEMS structure 72, a signal line 74 is shorted to the ground shielding 76-78 and results in the OFF state of the switch. This idea can be realized by fabricating the switch in three different detached parts 76, 78, 74 and then integrating them. Alternatively, the idea presented in FIG. 12 can be used to realize the switch. In this configuration, the switch 70 can be realized by fabricating the bottom plate 80 and the MEMS structure 72 on one wafer and the top cover 82 and the central signal line 84 on another wafer. A low k dielectric 86 can be used to separate the signal line and the ground shielding. Then, during the packaging stage, the wafers are bonded together. The RF MEMS coaxial switch can be also extended to multi port MEMS coaxial switches and switch matrices (similar to the multi port MEMS waveguide switches and switch matrices).

Figure 13:
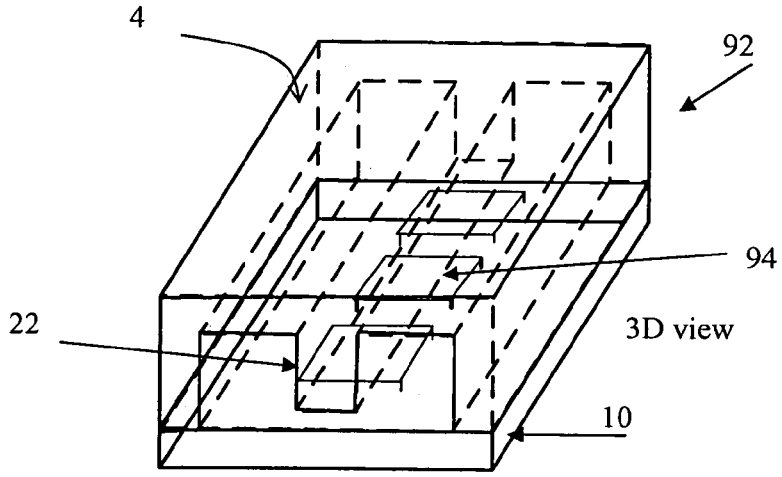
FIG. 13 is a schematic perspective view of a MEMS-based waveguide switch having plates that move upward or downward.
Figure 14:
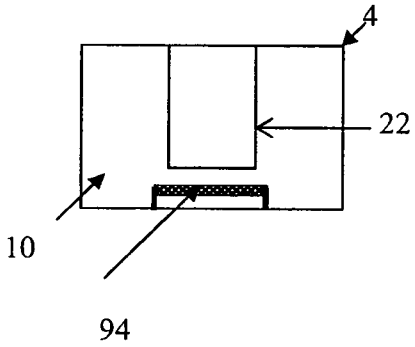
FIG. 14 is a partial schematic end view of the switch of FIG. 13.
Figure 15:
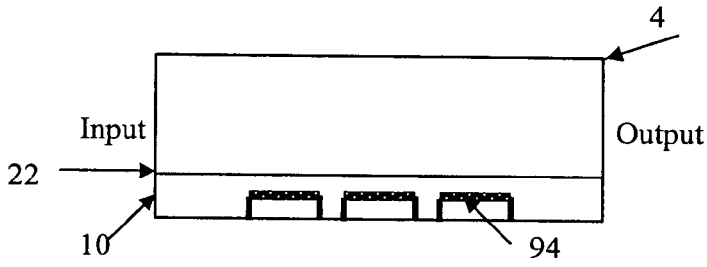
FIG. 15 is a side view of the switch of FIG. 14.

In FIGS. 13, 14 and 15, there is shown a switch 92 having a ridge waveguide 4 with a ridge 22 and a plurality of actuators 94 on a bottom plate 10. The switch 92 is similar to the switch 2 shown in FIG. 1 except that the actuators of the switch 92 do not pivot but move horizontally upward and downward. As shown in FIGS. 14 and 15, the actuators 94 are in the retracted or ON state. The actuators can be moved upward to provide a short between the top cover 4 and the bottom plate 10, thus moving the switch to the OFF state. As an alternative, the actuators 94 can be controlled to move closer to or further from the top cover 4 resulting in a controllable capacitive loading of the waveguide without shorting. The capacitive loading feature of the waveguide can be used as a variable inline capacitor to design a phase shifter or other components.

Figure 16:
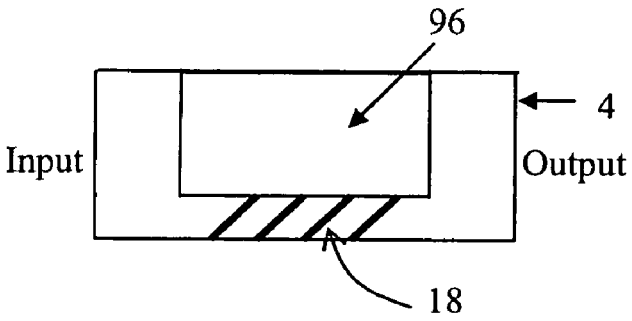
FIG. 16 is a schematic side view of a waveguide having MEMS actuators in an OFF position.
Figure 17:
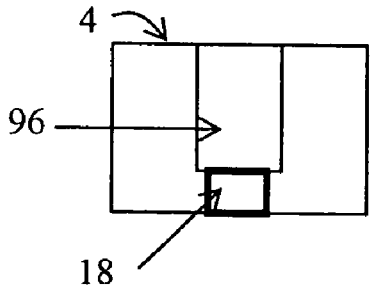
FIG. 17 is a schematic end view of the embodiment shown in FIG. 16.
Figure 18:
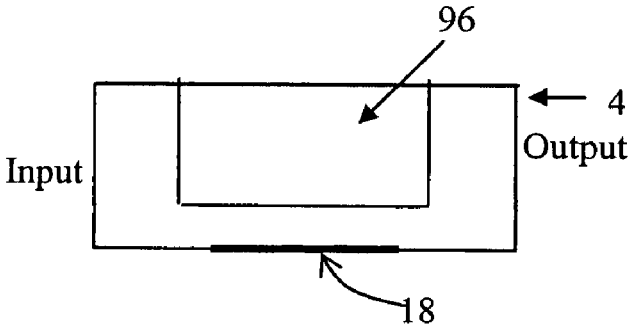
FIG. 18 is a schematic side view of the embodiment shown in FIG. 16 with the actuators in an ON position.
Figure 19:
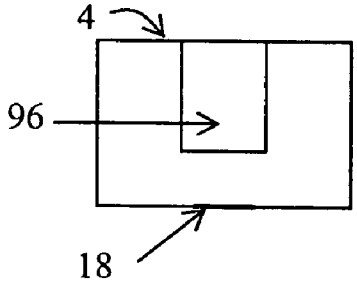
FIG. 19 is a schematic end view of the embodiment shown in FIG. 18.

In FIGS. 16 and 17, there is shown a schematic side view and end view respectively of a waveguide 4 containing a post 96 with actuators 18 in the OFF state. In FIGS. 18 and 19, the same reference numerals are used and the actuators 18 are in an ON state. By moving the actuators to the position shown in FIGS. 16 and 17, the post 96 is shorted to the lower side of the waveguide and the effect of the discontinuity or post is changed. This could be from a capacitive to inductive effect depending on the size of the post. The embodiment shown in FIGS. 16 to 19 has great potential for use as a tuning element for the filters.

Figure 20:
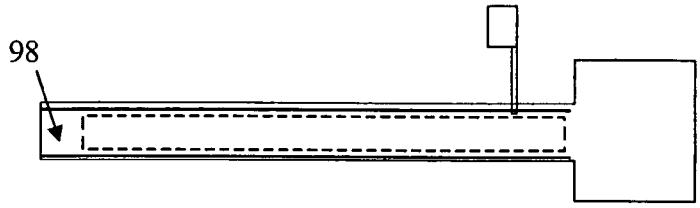
FIG. 20 is a top view of a bi-layer curled actuator.
Figure 21:
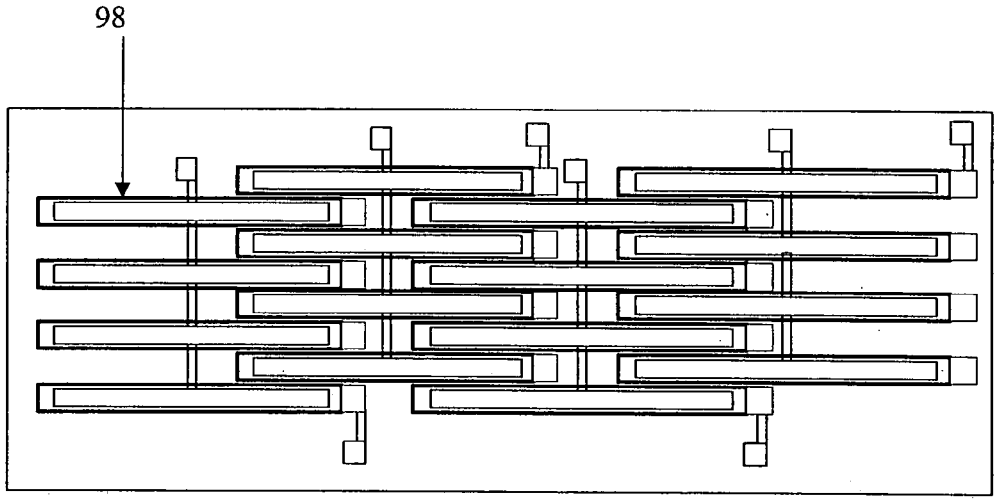
FIG. 21 is a top view of an entire actuator set of bi-layer curled actuators in an ON state.
Figure 22:
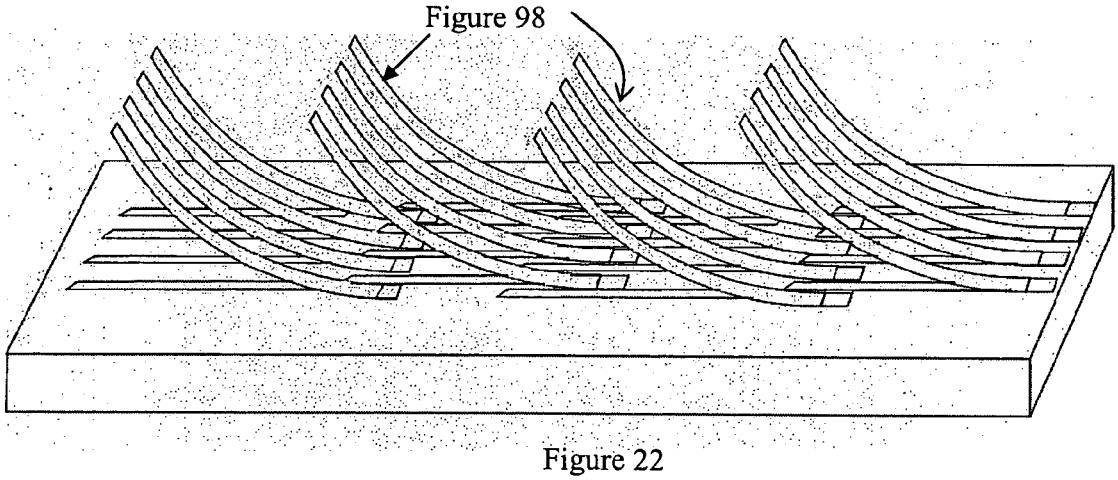
FIG. 22 is a schematic perspective view of bi-layer curled actuators in an OFF state.

In FIGS. 20 to 22 there are shown bi-layer curled actuators that are designed and fabricated using the Poly MUMPs surface machining process. Thermally plastic deformation assembly (TPDA) method is for the initial assembly of the beams. Afterwards, electrostatic voltage is used to roll the beams up and down. In FIG. 20, a fabricated actuator 98 is composed of 1.5 μm thick poly silicon and 0.5 μm gold layer on top. The beam is about 100 μm in width and 1,500 μm in length. Initially, after the release, the bimorph of gold and poly silicon assumes a planar geometry as shown in FIG. 21. When exposed to higher temperature (approximately 200° for ten minutes), the metal yields and upon the relaxation, a new stress mismatch results in a deformed beam toward the gold layer (top layer). This results in a curled beam or actuator as shown in FIG. 22. Another poly silicon layer (poly 0) under the beam is used as the electrode layer. To prevent the beam from collapsing to the bottom electrode, two stopper steps at both side edges of the beams are utilized. At the down position, these two steps contact the lower surface of the chip and stop the beam from unwanted collapse to the electrodes underneath. A voltage of approximately 20 volts seems to be required to roll the beam down. Upon the application of DC voltage, the beam starts rolling down until the entire beam coincides with the bottom surface of the chip. The entire actuator set consists of four rows of electrostatic actuators with each row including four bi-layer beams acting as shunt inductive irises in the OFF state. Application of four separate beams rather than a single plate helps to achieve better isolation in practice. The use of separate actuation mechanisms increases overall contact points and hence reduces the overall contact resistance. All of the actuators and the rest of the area of the chip are covered with gold layer to reduce the loss of the silicon base substrate.

The present invention can be used in high frequency devices, low frequency devices, high power devices and low power devices. The high frequency devices include microwave, milliliter, terahertz frequencies and beyond.

With the present invention, a MEMS structure is integrated with a three dimensional waveguide for RF applications. While actuators with specific types of MEMS structures are described, the invention is not limited thereto. Many types of actuators and MEMS structures will be suitable. The actuator can be a plate or a rod or strip or other convenient shape. In some embodiments, the actuators cause a short circuit between the top and bottom wall of a waveguide. However, it is not necessary in all applications of the invention for the actuators to cause a short circuit. In some applications, moving the actuators inside the waveguide will interfere sufficiently with a propagating wave in a desired manner. While the actuators have been described herein as having two positions, in some applications of the invention, more than two positions will be desirable. The actuators can be integrated in the bottom wall of a component or they can be integrated elsewhere inside the waveguide. The actuators can be located in a base plate or in a top cover and can be located on a ridge or on the side walls of a waveguide in some applications.

A ridge waveguide can be a single ridge waveguide or it can be a double ridge waveguide. The waveguide can be coaxial, planar, low temperature cofired ceramics, coplanar, rectangular or other shape as long as it is a three dimensional waveguide that will support an RF signal. The actuators can be electrostatic, thermal, magnetic, plastic deformation type or other suitable types.

We claim:

1. A MEMS-based RF component comprising a form, said form being a three dimensional waveguide having at least one inner wall surrounding said waveguide, said at least one inner wall being conductive, said form being capable of supporting a signal and having at least one of an input and output, said form having a MEMS structure at least partially therein, said MEMS structure being constructed to control an RF signal within said form while all inner walls of said at least one inner wall remain conductive.

2. A component as claimed in claim 1 wherein said MEMS structure has a first position and a second position.

3. A component as claimed in claim 2 wherein there is a controller to control movement of said MEMS structure.

4. A component as claimed in claim 3 wherein said MEMS structure has a plurality of actuators, said actuators being movable between said first position and said second position.

5. A component as claimed in claim 3 wherein said MEMS structure is located in said waveguide.

6. A component as claimed in claim 3 wherein said MEMS structure is integrated with said waveguide.

7. A component as claimed in claim 3 wherein said waveguide is at least one of a rectangular waveguide, a coaxial waveguide, a ridge waveguide, a single ridge waveguide and a double ridge waveguide.

8. A component as claimed in claim 7 wherein the component is one selected from the group of a switch, capacitor, variable capacitor, phase shifter and filter.

9. A component as claimed in claim 3 wherein said component is a switch, said form has a signal pat and said MEMS structure is located out of said pat in said first position and at least partially within said path in said second position.

10. A component as claimed in claim 9 wherein said switch is on in said first position and off in said second position.

11. A component as claimed in claim 8 wherein said component is a switch selected from the group of an R-switch, C-switch, a T-switch, single pole single throw switch, single pole double throw switch, switch matrix and coaxial switch, planar switch and waveguide switch integrated with a planar circuit.

12. A component as claimed in claim 4 wherein said actuators are at least one selected from the group of thermal, magnetic, electrostatic, curling actuators and plastic deformation type of actuators.

13. A component as claimed in claim 6 wherein said component is a C-switch with two input ports and two output ports of said at least one of an input and an output.

14. A component as claimed in claim 6 wherein said switch is a T-switch with two input ports and two output ports of said at least one of an input and output.

15. A component as claimed in claim 6 wherein said component is an R-switch with a maximum of two input ports and two output ports of said at least one of an input and output in any single position of said switch.

16. A component as claimed in claim 6 wherein said component is a coaxial switch with at least one input and at least one output of said at least one input and output.

17. A component as claimed in claim 6 wherein said component is a single pole double throw switch having one input and two outputs of said at least one input and output.

18. A component as claimed in claim 3 wherein said component has a ridge waveguide channel therein with a gap located above a bottom plate, said MEMS structure being located beneath said gap.

19. A component as claimed in claim 18 wherein said component has a top that is sized and shaped to fit onto said bottom plate, said ridge waveguide being located in said top.

20. A component as claimed in claim 3 wherein said component has at least one input port and at least one output port of said at least one input and output, said ports having transformers located therein.

21. A component as claimed in claim 4 wherein said actuators are constructed to short circuit said signal path to turn said switch off.

22. A component as claimed in claim 10 wherein said component has more than one signal path with a MEMS structure located at each signal path, said MEMS structure having actuators that are constructed to short circuit a signal path in which the actuators are located when said signal path is off.

23. A component as claimed in claim 22 wherein said actuators are constructed to be located outside of a signal path when said signal path is on.

24. A component as claimed in claim 19 wherein said top has gold plating thereon.

25. A component as claimed in claim 4 wherein said actuators are movable up and down in a switch to provide a short between a top and bottom plate when said switch is off and to be removed entirely to a position coinciding with said inner wall of a said waveguide when said switch is on, said actuators having a capacitive loading.

26. A component as claimed in claim 4 wherein said actuators are controlled to adjust an elevation of said actuators resulting an a controllable capacitative loading of said waveguide.

27. A component as claimed in claim 4 wherein said actuators are located and constructed to provide a variable inline capacitor.

28. A component as claimed in claim 27 wherein the variable inline capacitor is located in one of a phase shifter, tunable filter, matching network and any reconfigurable system.

29. A component as claimed in claim 1 wherein said component is constructed for use in a waveband selected from the group of microwave, millimeter, terahertz and beyond.

30. A component as claimed in claim 4 wherein the component is a switch matrix comprised of a plurality of switches that are interconnected to one another, said switch matrix having a plurality of inputs and a plurality of outputs of said at least one input and output, the plurality of switches in said switch matrix having a MEMS structure with a plurality of actuators that are movable between a first position and a second position.

31. A component as claimed in claim 3 wherein said component has a configuration that is selected from the group of a planar configuration, a coplanar-waveguide configuration and low temperature cofired ceramic configuration.

32. A component as claimed in claim 1 wherein the MTEMS structure is integrated on a planar circuit.

33. A component as claimed in claim 1 wherein the component is a wide-band ridge waveguide connected into a coplanar waveguide line transition.

34. A component as claimed in claim 33 wherein said MEMS structure is integrated onto a bottom plate and a waveguide channel and ridge are fabricated on a top cover.

35. A component as claimed in claim 34 wherein a microstrip line is used as an interface to transform a ridge waveguide mode to a coplanar waveguide mode.

36. A method of constructing a MEMS-based RF component having a three dimensional waveguide with a MEMS structure at least partially therein, said waveguide having at least one wall surrounding said waveguide, said at least one wall being conductive, said method comprising constructing a base plate and a top cover that is sized and shaped to fit on said base plate, one of said base plate and said top cover having a MEMS structure incorporated therein, and affixing said cover to said plate to form said component, constructing said MEMS structure so that said at least one wall remains conducting as said MEMS structure generates.

37. A method as claimed in claim 36 including the step of incorporating the MEMS structure in said base plate and incorporating a waveguide in said cover.

38. A method as claim in claim 37 including the step of incorporating a ridge waveguide in said cover.

39. A method as claimed in claim 37 including the step of fabricating the MEMS structure, the cover and the base plate by the same process monolithically.

40. A method as claimed in claim 36 including the steps of constructing the MEMS structure separately from said cover.

41. A method of operating an RF component having a form that is a three dimensional waveguide, said waveguide having at least one inner wall surrounding said waveguide, said at least one wall being conductive, said form having a MEMS structure at least partially therein with a controller for said MEMS structure, said method comprising operating said controller to move said MEMS structure to control an RF signal within said form while all inner walls of said at least one inner wall remain conductive.

* * * * *